United States Patent [19]

Crossin

[11] Patent Number: 4,582,636

[45] Date of Patent: Apr. 15, 1986

[54] CONCENTRATED HOMOGENEOUS BUILT LIQUID DETERGENT COMPOSITION

[75] Inventor: Michael C. Crossin, Kendall Park, N.J.

[73] Assignee: Colgate-Palmolive Co., New York, N.Y.

[21] Appl. No.: 682,972

[22] Filed: Dec. 18, 1984

[51] Int. Cl.[4] ..... C11D 1/34; C11D 1/83; C11D 1/90; C11D 3/36

[52] U.S. Cl. ..... 252/546; 252/173; 252/174.16; 252/174.19; 252/174.21; 252/527; 252/DIG. 1; 252/DIG. 14

[58] Field of Search ..... 252/173, 174.16, 174.19, 252/174.21, DIG. 1, DIG. 14, 527, 546

[56] References Cited

U.S. PATENT DOCUMENTS

| | | | |
|---|---|---|---|
| 3,235,505 | 2/1966 | Tuvell | 252/135 |
| 3,351,557 | 11/1967 | Almstead | 252/106 |
| 3,876,563 | 4/1975 | Collins | 252/545 |
| 3,912,662 | 10/1975 | Martinsson | 252/527 |
| 3,958,928 | 5/1976 | Lala | 8/25 |
| 4,122,043 | 10/1978 | Kersnar | 252/527 |
| 4,126,572 | 11/1978 | Tai | 252/173 |
| 4,261,869 | 4/1981 | Bishop | 252/542 |
| 4,284,532 | 8/1981 | Leikhim | 252/528 |

*Primary Examiner*—Dennis L. Albrecht

*Attorney, Agent, or Firm*—B. Lieberman; M. M. Grill; H. S. Sylvester

[57] ABSTRACT

A concentrated aqueous single-phase built liquid detergent composition is provided comprising:

(a) from about 15 to 18%, by weight of a water-soluble non-phosphate detergent builder salt;

(b) from about 15 to 23%, by weight, of a surface active nonionic detergent compound which is the condensation product of 5 to 9 moles of ethylene oxide with one mole of an aliphatic alcohol containing 12 to 15 carbon atoms;

(c) from about 1 to 6%, by weight of at least one amphoteric detergent compound selected from among a group of described betaine detergent compounds;

(d) from about 5 to 8%, by weight, of a solubilizer consisting essentially of an alkali metal salt of octyl phosphonate; and (e) from about 35 to 65%, by weight, water.

12 Claims, No Drawings

CONCENTRATED HOMOGENEOUS BUILT LIQUID DETERGENT COMPOSITION

BACKGROUND OF THE INVENTION

This invention relates to concentrated aqueous, built liquid detergent compositions suitable for laundry or presoak formulations. More particularly, it relates to aqueous built liquid detergent compositions which are highly concentrated in surfactant and builder and are provided as homogeneous, clear single-phase liquid solutions.

The formulation of concentrated built aqueous liquid detergent compositions has been a commercial objective in the detergent art in recent years. It is generally required that such compositions provide good detergency at low product concentration in the bath, contain water as the principal solvent and are in the form of homogeneous single-phase solutions which provide long-term shelf life without undergoing phase separation. Conventional liquid detergent compositions containing a detergency builder are generally not highly concentrated. That is, they are formulated as relatively dilute aqueous solutions so as to solubilize the builder and surfactant in the liquid composition. To provide the desired detergency, relatively high concentrations of such product are needed in the bath.

The term "concentrated" as used herein refers to liquid detergent compositions which can provide effective detergency at a product concentration equivalent to about "¼ cup" under U.S. washing conditions, namely about 60 ml of detergent composition per standard wash load (about 17 U.S. gallons for a top loading washing machine), which corresponds to a concentration of about 0.1% of liquid detergent composition in the wash bath. To achieve a commercially acceptable level of detergency at such low product concentration, it is necessary that a high proportion of the detergent composition be comprised of active ingredients, notably, surfactant and builder. Thus, the term "concentrated" liquid detergent as used herein, is defined as a detergent composition which contains no more than about 65%, by weight, water.

As a practical matter, it is important that water is used as the principal, is not the sole, solvent in such concentrated liquid detergent composition, avoiding the use of costly solvents such as glycols. Accordingly, the liquid detergent compositions described herein contain at a minimum about 35% water, by weight of the liquid composition, a water content of about 45% to 60% being ordinarily preferred.

Built liquid detergent compositions are known in the art. However, because of the limited solubility of builder and surfactant in water, such detergent compositions are generally prepared as relatively dilute aqueous compositions containing for the most part in excess of 65%, and often as high as 93%, by weight, water. Frequently, an alkylene glycol co-solvent is used to enhance the solubility of the built detergent composition. In those aqueous compositions which contain less than 65% water, the proportion of builder is generally kept low, i.e. no greater than about 10%, by weight, so as to enhance the solubility of the built detergent in water. To provide acceptable detergency when used under standard U.S. washing conditions, such known liquid compositions are conventionally used at product concentrations substantially above the "¼ cup" concentration (about 0.1%, by weight) at which the liquid detergent compositions of the present invention are effective. Moreover, the conventional detergent compositions are generally in the form of emulsions or suspensions rather than forming clear homogeneous solutions which are stable against the phase separation.

The detergent compositions described in U.S. Pat. No. 3,912,662 to Martinsson et al and U.S. Pat. No. 4,021,377 to Borchert et al are illustrative of the prior art. The Martinsson et al patent discloses an aqueous detergent composition containing nonionic and betaine detergents and a polyphosphate builder. In example 1, a composition is described containing 66% water and 12% alkylene glycol as the solvent. The Borchert et al patent describes a phosphate-free liquid detergent composition containing citrate builder and surfactant in a water-glycol solvent. The amount of water in each of the seven compositions disclosed in Table 1 of the patent is less than 26%, by weight, the major portion of the solvent being an alkylene glycol. Consequently, the ability to provide an economical liquid detergent composition which utilizes water as the principal solvent yet is in the form of a concentrated clear single-phase solution remains as a problem yet to be overcome in formulating a commercially acceptable built concentrated liquid detergent composition.

SUMMARY OF THE INVENTION

The present invention provides a concentrated aqueous single-phase homogeneous built liquid detergent composition comrising;

(a) from about 15 to 18%, by weight, of a water-soluble non-phosphate detergent builder salt;

(b) from about 15 to 23%, by weight, of a surface active nonionic detergent compound which is the condensation product of 5 to 9 moles of ethylene oxide with one mole of an alphatic alcohol containing 12 to 15 carbon atoms;

(c) from about 1 to 6%, by weight, of at least one amphoteric detergent compound selected from the group consisting of (i) betaine detergent compounds having the structure:

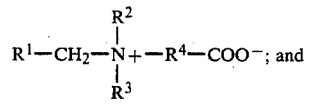

(ii) alkyl amido betaine detergent compounds having the structure:

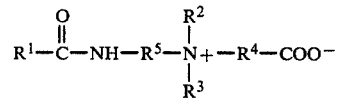

wherein $R^1$ is an alkyl or a mixture of alkyls containing 9 to 13 carbon atoms, $R^2$ and $R^3$ are independently methyl or ethyl, and $R^4$ and $R^5$ are independently methylene, ethylene or propylene radicals;

(d) from about 5 to 8%, by weight, of a solubilizer consisting essentially of an alkali metal salt of octyl phosphonate; and (e) from about 35 to 65%, by weight, water In accordance with the process of the invention, laundering of stained and/or soiled materials is affected by cnntacting such materials with an aqueous solution of the above-defined liquid detergent composition.

Unlike the built liquid detergent compositions known in the art, the compositions of the present invention contain a high concentration of builder and surfactant yet are characteristically clear, single-phase homogeneous solutions which are physically stable over prolonged periods of storage and over a wide range of temperature. The particular combinations of nonionic and betaine detergents with non-phosphate builder salt and solubilizer in accordance with the invention unexpectedly form clear single-phase aqueous solutions, highly concentrated in both surfactant and builder. From a commercial standpoint, the present compositions are particularly advantageous: they are relatively economical to formulate in that they utilize water as the principal solvent and avoid the use of costly co-solvents such as alkylene glycols in other than minor amounts; they provide effective detergency at low product concentrations in the wash bath, notably at a so-called ¼ cup concentration, a desirably low concentration under U.S. washing conditions; and they are homogeneous solutions, avoiding problems of non-uniformity and phase separation associated with the storage and use of emulsions and dispersions.

The nonionic detergent compound in the described liquid detergent compositions may constitute from about 15 to 23%, and preferably from 17 to 19%, by weight, of the detergent composition. and the amphoteric detergent compound will generally vary from about 1 to 6%, preferably from 2 to 4%, by weight, of such compositions. The relative amounts of each of the aforementioned detergents is generally determined by the amount of builder salt employed. The higher the builder concentrations within the range of 15 to 18%, the lower the maximum concentration of nonionic detergent which may be employed in the composition and still form a stable single-phase solution. Conversely, at higher concentrations of builder salt, the concentration of amphoteric detergent and solubilizer is preferably increased within the ranges of concentration set forth above so as to solubilize the mixture and form a clear single-phase solution having the requisite detergency. Thus, for example, at a builder concentration of about 17% or above, the preferred concentration of nonionic surfactant is from about 16 to 18%, the amphoteric detergent is from about 2 to 4%, and most desirably at least 3%, and the concentration of solubilizer is about 7 to 8%, all percentages being by weight of the total composition.

DETAILED DESCRIPTION OF THE INVENTION

The synthetic nonionic detergent employed in the practice of the invention is specific to those compounds which are the condensation product of 5 to 9 moles of ethylene oxide with an aliphatic alcohol containing 12 to 15 carbon atoms. The aliphatic alcohol is preferably a straight chain alcohol, and most preferably is a fatty alcohol or mixture thereof containing an average of 12 to 13 carbon atoms per mole. The number of ethylene oxide groups per mole of alcohol preferably averages about 6.5 or 7, Neodol ®23-6.5 and Neodol ®25-7 are particularly preferred for use herein, both of such products being made by Shell Chemical Company, Inc.

The amphoteric detergent compounds most useful in the compositions of the invention are the betaine and alkyl amido betaine detergent compounds having the following structures:

(i) betaine

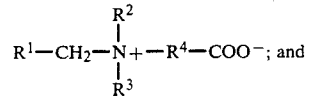

(ii) alkyl amido betaine

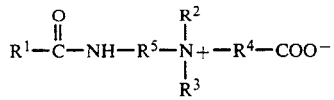

wherein in each of the above structures $R^1$ represents an alkyl chain or a mixture of alkyls containing 9 to 13 carbon atoms; $R^2$ and $R^3$ are independently methyl or ethyl; and $R^4$ and $R^5$ are independently methylene, ethylene or propylene radicals.

When $R^1$ is a mixture of alkyls of varying chain lengths, it is preferred that such mixture be comprised predominantly of alkyls having 9 to 13 carbon atoms, although it is sufficient, albeit less preferred, if only the predominant alkyl in the mixture contains 9 to 13 carbon atoms and the remaining alkyl chains are outside of such range. $R^1$ is preferably derived from coconut oil.

$R^2$, $R^3$ and $R^4$ are preferably methyl groups and $R^5$ is preferably a propylene radical. Accordingly, preferred betaines for use herein are cocodimethylammonium acetate (cocobetaine) and cocoamidopropyl dimethylammonium acetate (cocoamido betaine).

An anionic detergent may optionally be employed in minor amounts to supplement the nonionic and amphoteric detergent compounds in the present liquid detergent compositions. Generally, the amount of anionic detergent will be below about 3%, by weight, of the total composition because of the limited solubility of such detergents in the built liquid d detergent composition. Alkyl benzene sulfonate salts wherein the alkyl group contains 10 to 18 carbon atoms are particularly limited in solubility in the present compositions, and hence it is preferred that the present compositions be substantially free of such compounds to avoid the possibility of product separation.

The preferred anionic detergents for use herein are sulfated ethoxylated higher fatty alcohols of the formula $RO(C_2H_4O)_mSO_3M$, wherein R is a fatty alkyl of from 10 to 18 or 20 carbon atoms, m is from 2 to 6 or 8 (preferably having a value from about 1/5 to ½ the number of carbon atoms in R) and M is a solubilizing salt-forming cation, such as an alkali metal, ammonium, lower alkyl-amino or lower alkanolamino. A preferred polyethoxylated alcohol sulfate detergent is available from Shell Chemical Company and is marketed as Neodol 25-3S.

Water is the principal solvent in the concentrated liquid detergent compositions. The concentration of water may vary from about 35 to 65%, with a concentration in the range of 45 to 60%, by weight, being generally preferred. A co-solvent such as an alkylene glycol, e.g. ethylene glycol or propylene glycol, may optionally be employed in minor amounts for purposes of enhancing the solubility of the surfactant and builder in solution. The concentration of alkylene glycol in the detergent composition should, if present, be below about 10%, by weight, of the total composition, preferably below about 5%, and most preferably, the composition is substantially free of such alkylene glycol.

An alkali metal salt of octyl phosphonate is included in the detergent composition because of its solubilizing properties with respect to nonionic surfactants and builder salts. Such solubilizer is used in an amount of from 5 to 8%, by weight, of the total composition, a concentration of at least 7% being preferred when the builder salt concentration is about 17% or higher.

Octyl phosphonate is represented by the formula

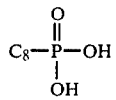

wherein $C_8$ represents an eight carbon member aliphatic chain, preferably alkyl.

The non-phosphate detergent builder salts are employed in the present compositions in amounts generally of from about 15 to 18%, by weight. Specific examples of non-phosphate water-soluble inorganic builders include water-soluble inorganic carbonate, bicarbonate and silicate salts. The alkali (for example, sodium and potassium) carbonates, bicarbonates and silicates are particularly useful herein.

Water-soluble organic builders are also useful and include the alkali metal, ammonium and substituted ammonium polyacetates, carboxylates, polycarboxylates and polyhydroxysulfonates. Specific examples of polyacetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-) acids, carboxymethyoxysuccinic acid and citric acid. As used herein, the term "builder" does not include surfactants and soaps such as the water-soluble salts of higher fatty acids containing from about 8 to 20 carbon atoms.

The optical fluoresecent brighteners or whiteners employed in the liquid detergent compositions are important constituents of modern detergent compositions which give washed laundry and materials a bright appearance so that the laundry is not only clean but also appears clean. Although it is possible to utilize a single brightener for a specific intended purpose in the present liquid detergent compositions it is generally desirable to employ mixtures of brighteners which will have good brightening effects on cotton, nylons, polyesters and blends of such materials and which are also bleach stable. A good description of such types of optical brighteners is given in the article "The Requirements of Present day Detergent Fluorescent Whitening Agents" by A. E. Siegrist, J. Am. Oil Chemists Soc., January 1978 (Vol. 55). That article and U.S. Pat. No. 3,812,041, issued May 21, 1974, both of which are hereby incorporated by reference contain detailed descriptions of a wide variety of suitable optical brighteners.

Among the brighteners that are useful in the present liquid detergent compositions are: Calcofluor 5 BM (American Cyanamid); Tinopal LPW (Ciba); SOF A-2001 (Ciba); CDW (Hilton-Davis); Phorwite RKH, Phorwite BBH and Phorwite BHC (Verona); CSL, powder, acid (American Cyanamid); FB 766 (Verona); Blancophor PD (GAF); UNPA (Geigy); Tinopal RBS 200 (Geigy).

Adjuvants may be present in the liquid detergent compositions to provide additional properties, either functional or aesthetic. Included among the useful adjuvants are soil suspending or antiredoposition agents, such as polyvinyl alcohol, sodium carboxymethyl cellulose, hydroxypropylmethyl cellulose; thickeners, e.g., gums, alginates, agar agar; foam improvers, e.g., lauric myristic diethanolamide; foam destroyers, e.g., silicones; bactericides, e.g., tribromosalicylanilide, hexachlorophene; dyes; pigments (water dispersible); preservatives; ultraviolet absorbers; fabrics softeners; enzymes; opacifying agents, e.g., polystyrene suspensions; and perfumes. Of course, such materials will be selected based on the properties desired in the finished product, their compatibility with the other constituents, and their solubility in the liquid composition.

The present liquid compositions are efficient and easy to use. Compared to heavy duty laundry detergent powders, much smaller volumes of the present liquids are employed to obtain comparable cleaning of soiled laundry. For example, using a typical preferred formulation of this invention, only about 71 grams or ¼ cup of liquid is needed for a full tub of wash in a top-loading automatic washing machine in which the water volume is about 17 gallons (about 64 liters); and even less is needed for front-loading machines. Thus, the concentration of the liquid detergent composition in the wash water is on the order of about 0.1%. Usually, the proportion of the liquid composition in the wash solution will range from about 0.05 to 0.3%, preferably from 0.10 to 0.20%. The proportions of the various constituents of the liquid composition may vary accordingly. Equivalent results can be obtained by using greater proportions of a more dilute formulation but the greater quantity needed will require additional packaging and will generally be less convenient for consumer use.

EXAMPLE 1

A concentrated built liquid detergent composition in accordance with the invention was formulated as set forth below. The percentages shown refer to the 100% active component.

| COMPONENT | WEIGHT PERCENT |
|---|---|
| Sodium Citrate | 17.2 |
| Ethoxylated $C_{12}$—$C_{13}$ alcohol (6.5 moles EO/mole alcohol) | 17.6 |
| Cocoamido betaine[1] | 3.1 |
| Octyl phosphonate[2] (Potassium salt) | 7.0 |
| Brightener and dye | 0.2 |
| Water | Balance |

[1]Provided as "Varion CADG", an aqueous solution of coco-amido betaine sold by Sherex Chemical Company.

[2]The phosphonate is provided as "Hoe S-2413" sold by American Hoechst Company, which is then reacted with potassium hydroxide to form the potassium salt.

The above-described liquid composition was a clear blue-colored single-phase homogeneous liquid detergent having a viscosity of about 80 cp. at 75° F., and which poured satisfactorily from a plastic detergent bottle with a discharge opening of about 2.5 cm. The liquid detergent was employed to wash a mixed load of soiled laundry which included cotton swatches and polyester/cotton swatches soiled with particulate soil and with sebum soil. The wash temperature was 120° F. and the concentration of the liquid detergent in the wash bath was about 0.1%, by weight. After washing, the laundered items were rinsed in top water and then dried. The degree of stain removal was measured by taking a reflectance reading for each stained test swatch prior to and after the washing using a Gardner XL-20 colorimeter.

The laundering operation described above was repeated with a control detergent, a commercial aqueous built liquid detergent composition containing 19% dodecylbenzene sulfonate, 10% sodium citrate, 7% ethoxylated alcohol surfactant, and 5% sodium toluene sulfonate hydrotrope used at a "½ cup" concentration of about 0.2%, by weight, in the bath. The detergency of both compositions was compared based on the measured stain removal achieved during laundering. The detergency of the liquid detergent of the invention at a "¼ cup" concentration was shown to be either equivalent to or superior to that achieved with the control liquid detergent at a "½ cup" concentration with respect to laundered soiled and stained fabrics.

EXAMPLE 2

The effect of incorporating a betaine detergent not in accordance with the invention into a built liquid detergent composition containing nonionic surfactant and a high concentration of builder was demonstrated by preparing two liquid compositions such as described in Example 1, except that the cocoamido betaine in the composition of Example 1 was replaced in one composition by stearyl betaine and in the second composition by palmytyl betaine. Both of the resulting compositions were unstable and formed separate phases in contrast to the stable clear solution which characterized the composition of Example 1.

EXAMPLE 3

Detergency tests were conducted with compositions A and B formulates as shown below. The numbers in the table represent the percent by weight, of each component in the liquid composition.

| COMPONENT | A | B |
|---|---|---|
| Sodium citrate | 17.2 | 17.2 |
| Ethoxylated $C_{12}$—$C_{13}$ alcohol (6.5 moles EO/mole alcohol) | 17.6 | 22.0 |
| Cocoamido betaine | 3.1 | — |
| Octyl phosphonate (potassium salt) | 7.0 | 14.0 |
| Water | Balance | Balance |

Compositions A and B were clear, single-phase solutions. Compositions A is a composition of the invention previously described in Example 1. Composition B represents the best performing formulation from the standpoint of detergency measured at a concentration of 0.1% in the bath from among compositions containing the same components of Composition A except for the omission of a betaine detergent, and which formed a clear single-phase soltuion. Compositions B is not in accordance with the invention.

The detergency of Compositions A and B was determined in a Tergometer vessel manufactured by U.S. Testing Company on the following test fabrics under the stated conditions:

TEST FABRICS

TFN—Test fabric soil on Nylon
PCC—Piscataway clay on cotton
TFC—Test fabric soil on cotton
PCDC—Piscataway clay on Dacron/cotton
EMPA—EMPA 1010 on heavy cotton

WASH CONDITIONS

Liquid detergent concentration—0.10%
Water temperature—120° F.
Water hardness—About 150 ppm as calcium carbonate At the end of the wash, the test swatches were rinsed in tap water and then dried. A reflectance reading was taken for each test swatch prior to and after the washing using a Gardner XL-20 colorimeter. The vlaues for the change in reflectance (ΔRd) are shown below in Table 1 for each of the aforementioned test fabrics. A difference greater than 0.8 betwen two values of ΔRd is considered significant for all washed test fabrics except for measurments on EMPA and PCDC where only ΔRd values above 1.3 are considered significant.

TABLE 1

| | ΔRd Values for Fabrics Washed with Compositions A and B | | | | |
|---|---|---|---|---|---|
| COMPOSITION | TFN | PCC | EMPA | TFC | PCDC |
| A | 38 | 25 | 18 | 8 | 32 |
| B | 35 | 24 | 17 | 8 | 33 |

Table 1 demonstrates the unexpected improved detergency attendant to the use of a composition in accordance with the invention relative to a single-phase liquid detergent compositions similar thereto but which was not formulated in accordance with the invention. Composition A is shown to be superior to Composition B with respect to the two of five test fabrics laundered; and essentially equivalent in detergency with respect to the other three laundered fabrics.

What is claimed is:

1. A concentrated aqueous single-phase homogeneous built liquid detergent composition comprising:

(a) from about 15 to 18%, by weight of a water-soluble non-phosphate detergent builder salt;

(b) from about 15 to 23%, by weight, of a surface active nonionic detergent compound which is the condensation product of 5 to 9 moles of ethylene oxide with one mole of an alphatic alcohol containing 12 to 15 carbon atoms;

(c) from about 1 to 6%, by weight, of at least one amphoteric detergent compound selected from the group consisting of (i) betaine detergent compounds having the structure:

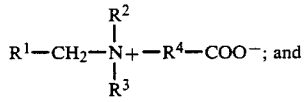

(ii) alkyl amido betaine detergent compounds having the structure:

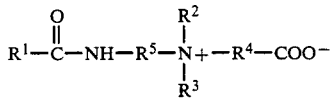

wherein $R^1$ is an alkyl or a mixture of alkyls containing 9 to 13 carbon atoms, $R^2$ and $R^3$ are independently methyl or ethyl and $R^4$ and $R^5$ are independently methylene, ethylene or propylene radicals;

(d) from about 5 to 8%, by weight, of a solubilizer consisting essentially of an alkali metal salt of octyl phosphonate; and (e) from about 35 to 65%, by weight, water.

2. A detergent composition as in claim 1 wherein said nonionic detergent compound is the condensation product of 6 to 7 moles of ethylene oxide with one mole of an aliphatic alcohol containing 12 to 13 carbon atoms.

3. A detergent composition as in claim 1 wherein said builder salt is sodium citrate.

4. A detergent composition as in claim 1 wherein $R^1$ in the structures of said betaine detergent compounds is derived from coconut oil, $R^2$ and $R^3$ are each methyl, and $R^4$ is methylene.

5. A detergent composition as in claim 1 wherein said betaine detergent compound is cocoamidopropyldimethyl ammonium acetate.

6. A detergent composition as in claim 1 which contains less than about 3%, by weight, of a surface active anionic detergent compound.

7. A detergent composition as in claim 1 which is substantially free of a $C_{10}$–$C_{18}$ alkyl benzene sulfonate anionic detergent.

8. A detergent composition as in claim 1 which contains less than about 10%, by weight, of an alkylene glycol.

9. A detergent composition as in claim 1 which is substantially free of an alkylene glycol.

10. A detergent composition as in claim 1 which contains from about 45 to 60%, by weight, water.

11. A detergent composition as in claim 1 wherein the concentration of builder salt is about 17% and the range of nonionic detergent compound is from about 16 to 18%, by weight, of the composition.

12. A detergent composition as in claim 1 wherein the concentration of said solubilizer in the composition is about 7%, by weight.

* * * * *